US012116730B2

(12) United States Patent
Spender et al.

(10) Patent No.: US 12,116,730 B2
(45) Date of Patent: Oct. 15, 2024

(54) METHOD OF MODIFYING POLYMER BARRIER FILMS

(71) Applicant: ChemStone, Inc., Greenville, SC (US)

(72) Inventors: Jonathan Spender, Enfield, ME (US); Michael Albert Bilodeau, Clermont, FL (US); Samuel Mikail, Singapore (SG)

(73) Assignee: ChemStone, Inc., Greenville, SC (US)

( * ) Notice: Subject to any disclaimer, the term of this patent is extended or adjusted under 35 U.S.C. 154(b) by 296 days.

(21) Appl. No.: 17/604,310

(22) PCT Filed: Apr. 15, 2020

(86) PCT No.: PCT/IB2020/053564

§ 371 (c)(1),
(2) Date: Oct. 15, 2021

(87) PCT Pub. No.: WO2020/212873

PCT Pub. Date: Oct. 22, 2020

(65) Prior Publication Data

US 2022/0205184 A1 Jun. 30, 2022

Related U.S. Application Data

(60) Provisional application No. 62/834,588, filed on Apr. 16, 2019.

(51) Int. Cl.

| | |
|---|---|
| ***D21H 19/82*** | (2006.01) |
| ***D21H 19/20*** | (2006.01) |
| ***D21H 21/16*** | (2006.01) |

(52) U.S. Cl.

CPC ..... *D21H 19/824* (2013.01); *D21H 19/20* (2013.01); *D21H 21/16* (2013.01)

(58) Field of Classification Search

CPC ..... D21H 19/824; D21H 19/20; D21H 21/16
USPC ..... 162/137
See application file for complete search history.

(56) References Cited

U.S. PATENT DOCUMENTS

| | | | |
|---|---|---|---|
| 4,002,781 | A | 1/1977 | Fock et al. |
| 2007/0128247 | A1 | 6/2007 | Kato |
| 2007/0295466 | A1 | 12/2007 | Fugitt et al. |
| 2018/0126607 | A1 | 5/2018 | Joyce et al. |
| 2019/0002725 | A1 | 1/2019 | Zischka et al. |

FOREIGN PATENT DOCUMENTS

| | | | |
|---|---|---|---|
| EP | 3 660 113 | A1 | 6/2020 |
| JP | 2012030369 | | 2/2012 |
| WO | 96/01736 | A1 | 1/1996 |
| WO | 2013/180643 | A1 | 12/2013 |
| WO | 2020/109403 | A1 | 6/2020 |

OTHER PUBLICATIONS

International Search Report for PCT/IB2020/053564 dated Aug. 10, 2020 [PCT/IA/210].
Written Opinion for PCT/IB2020/053564 dated Aug. 10, 2020 [PCT/IA/237].

*Primary Examiner* — Dennis R Cordray
(74) *Attorney, Agent, or Firm* — Dority & Manning, P.A.

(57) ABSTRACT

The present disclosure describes a method to modify dried polymer films using printed crosslinking agents, including that the crosslinked polymer resulting from the method exhibits greater insolubility compared to crosslinked polymers made where the crosslinking agent and the polymer are combined and applied as a homogenous solution. Articles of manufacture generated by such a method are also disclosed.

20 Claims, 1 Drawing Sheet

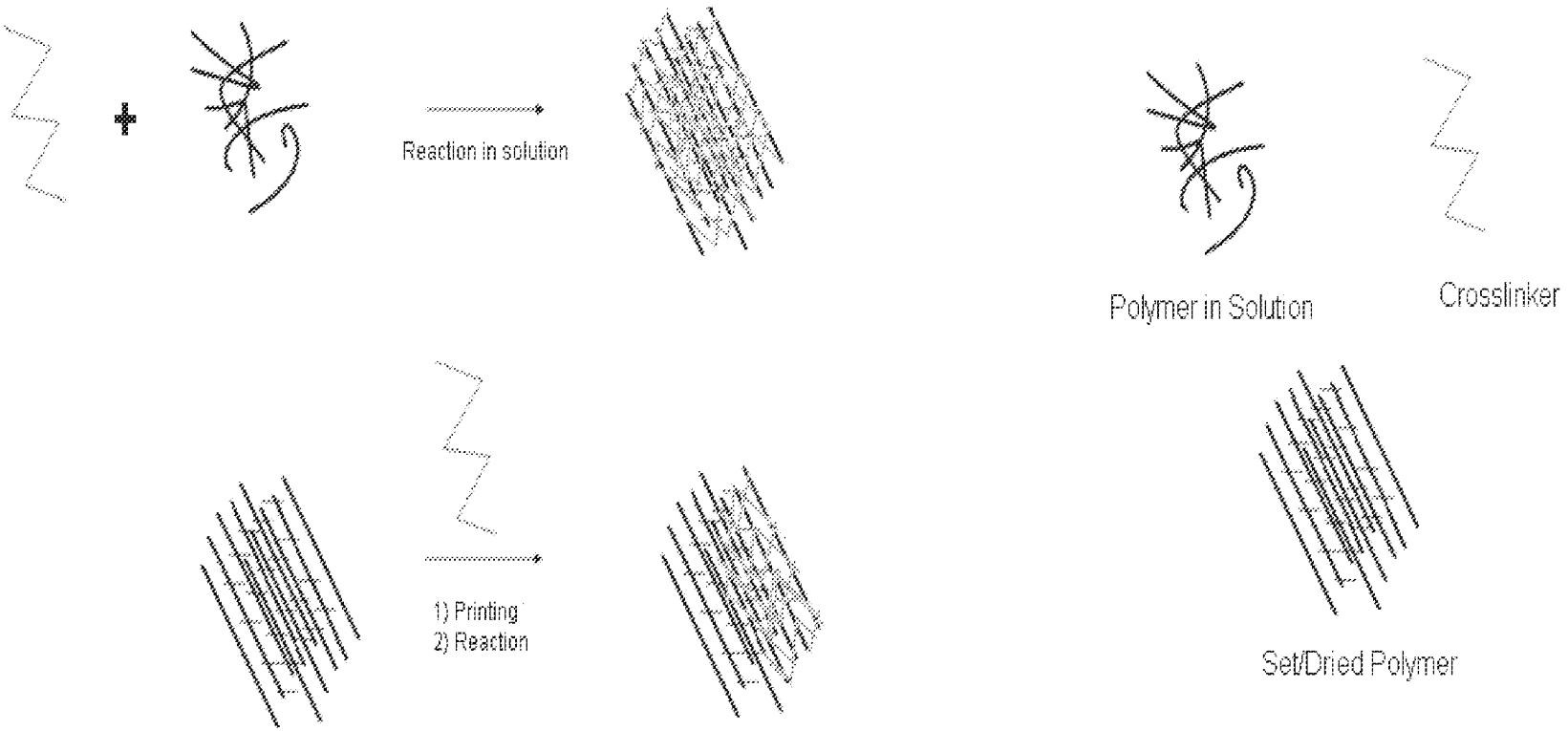
Crosslinker
Polymer in Solution
Set/Dried Polymer
Reaction in solution
1) Printing
2) Reaction

METHOD OF MODIFYING POLYMER BARRIER FILMS

BACKGROUND OF THE INVENTION

CROSS REFERENCE TO RELATED APPLICATIONS

This application is a National Stage of International Application No. PCT/IB2020/053564 filed Apr. 15, 2020, claiming priority based on U.S. Patent Application No. 62/834,588 filed Apr. 16, 2019.

Field of the Invention

The present invention relates generally to barrier films, specifically to methods of preparing crosslinked films, including compositions that form such films and articles of manufacture made with such films.

Background Information

Film-based barrier coatings are widely used in packaging materials to prevent the passage of liquids, gases, odorants and the like, including preventing contact between the contents of a package and a permeant. Improving barrier properties is an important goal for manufacturers of films sold for containment of products such as foods, cosmetics, agricultural chemicals, and pharmaceuticals. While the use of plastic materials is typically part of such coatings, recently use of plastics, especially fossil fuel-based plastics, have fallen out of favor as they have come under consumer/market pressure because of their lasting effects on the environment.

Films consisting of a thermoplastic resin, oriented films of polypropylene, polyester, and polyamide typically have excellent mechanical properties, heat resistance, transparency and are widely used as packaging materials. Typical barrier materials are a single layer of polymer, a bilayer co-extruded or laminated polymer film, a coated monolayer, or a bilayer or multilayer film having one or more coatings on a surface or both surfaces. Other barrier technologies include metallization with thin coatings of aluminum to various base film structures using vacuum deposition.

Polyvinyl alcohol (hereinafter, may be abbreviated as "PvOH") is known as a water-soluble synthetic polymer. PvOH is particularly excellent in strength and film forming properties compared with other synthetic polymers. PvOH is therefore used as a material for film and fiber, an additive for paper and fiber processing, an adhesive, a stabilizer for emulsion polymerization and suspension polymerization, a binder for inorganics, and the like. PvOH is thus heavily used in various applications.

There are many processes for the formation of films, including aqueous coating and/or metering, calendering, extrusion, plastisol cast systems, and organosol cast systems. Extrusion and calendering are processes which melt the polymer and shape the plastic prior to freezing. Plastisol and organosol casting processes involve the melting of the polymer in a plasticizer matrix, after which the solvent action of the plasticizer forms a film.

In prior methods and apparatus, the solution that is eventually cast onto a moving surface, containing the base polymer and secondary components such as plasticizers, fillers, surfactants, actives, and colorants, is prepared by combining the base polymer and secondary components with water in a tank and then mixing. The homogeneous solution or suspension is then pumped through one or more operations including de-aeration and filtering and then fed to a solution casting die for casting onto the moving surface, such as a traveling belt.

Recently, a method for continuously preparing a solvent cast film using a pressurized stream of PvOH solution and combining a fluid stream containing a crosslinking agent, mixing the combination of PvOH solution and crosslinking agent stream in-line, continuously applying the resulting homogeneous mixture of PvOH solution and crosslinking agent to a moving surface, and then evaporating solvent from the mixture has been developed (see, e.g., U.S. Pub. No. 2007/0085235, herein incorporated by reference in its entirety). However, such a method requires complicated machinery and the use of multiple solvents.

It would be desirable to design a method using simpler process steps/equipment to achieve films having desired barrier coating properties.

SUMMARY OF THE INVENTION

The present disclosure relates to film making methods, including methods to modify polymer films using printed crosslinking agents such that the resulting crosslinked polymer is less soluble compared to crosslinked polymers made where the crosslinking agent and the polymer are combined in solution. Articles of manufacture generated by such methods are also disclosed.

In embodiments, a method of preparing a crosslinked film is disclosed including applying a polymer solution to a substrate; drying said polymer solution on the substrate; printing a crosslinking agent on the dried substrate; and heating the printed substrate for a sufficient time to achieve crosslinking, where the resulting crosslinked polymer exhibits greater insolubility relative to a crosslinked polymer generated by application of the same polymer and crosslinking agent combined in solution. In a related aspect, the method further includes optionally evaporating any solvent from the heated substrate to form a crosslinked polymeric film.

In one aspect, the polymer includes polyvinyl alcohols, polyethylene oxides, dextrans, starches, cellulose derivatives (e.g., hemicelluloses, hydroxyethyl cellulose, hydroxypropyl cellulose, and other cellulose ethers), lignins, polyvinylpyrrolidone, polyacrylamide, polyacrylic acid, polyacrylates, pectin, alginates, proteins, derivatized proteins (e.g., gelatin, corn zein, whey protein) and combinations thereof. In a related aspect, the polymer is polyvinyl alcohol.

In another aspect, the substrate is a cellulosic material.

In one aspect, the crosslinking agent includes aldehydes, aldehyde-containing resins, polyfunctional carboxylic acids, difunctional methacrylates, N-lactam carboxylates, dithiols, dimethyl urea, di-isocyanates, borates, salts of multivalent anions, inorganic polyions, Group 1B salts, polyamide-epichlorohydrin resin, and combinations thereof.

In a related aspect, the crosslinking agent includes aldehydes, aldehyde-containing resins, dicarboxylic acids, and combinations thereof. In a further related aspect, the crosslinking agent comprises an aldehyde. In a related aspect, the crosslinking agent comprises a dialdehyde. In another related aspect, the crosslinking agent includes glyoxal, glutaraldehyde, or a mixture thereof. In a further related aspect, the crosslinking agent is glyoxal.

In one aspect, the crosslinking agent is present in an amount up to about 10% by weight based on the weight of the polymer. In another aspect, the polymer is present in an amount in a range of about 50% to 90% by weight, based on the weight of the polymer solution.

In another aspect, the printing includes flexography, rotogravure, ink jet, Indigo, and offset printing.

In one aspect, the cellulosic-material includes paper, paperboard, paper pulp, a carton for food storage, a bag for food storage, a shipping bag, a container for coffee or tea, a tea bag, bacon board, diapers, weed-block/barrier fabric or film, mulching film, plant pots, packing beads, bubble wrap, oil absorbent material, laminates, envelops, gift cards, credit cards, gloves, raincoats, OGR paper, a shopping bag, a compost bag, release paper, eating utensil, container for holding hot or cold beverages, cup, paper towels, plate, a bottle for carbonated liquid storage, insulating material, a bottle for non-carbonated liquid storage, film for wrapping food, a garbage disposal container, a food handling implement, a lid for a cup, paper straws, a fabric fibre, a water storage and conveying implement, paperboard from medical use, release paper, a storage and conveying implement for alcoholic or non-alcoholic drinks, an outer casing or screen for electronic goods, an internal or external piece of furniture, a curtain, upholstery, film, box, sheet, tray, pipe, water conduit, packaging for pharmaceutical products, clothing, medical device, contraceptive, camping equipment, cellulosic material that is molded and combinations thereof.

In one aspect, the method tuneably derivatizes the substrate for hydrophobic and/or lipophobic resistance. In a related aspect, the resulting substrate is hydrophobic. In a further related aspect, the resulting substrate is lipophobic. In another related aspect, the resulting substrate exhibits a 3M grease KIT test value of between 3 and 12.

In one aspect, the polymer solution is provided as an emulsion.

In another aspect, the polymer solution comprises one or more of clay, carbonates, calcium carbonate, titanium dioxide, plastic pigment, binders, starch, protein, polymer emulsions, latex, zirconium salts, calcium stearate, lecithin oleate, polyethylene emulsion, carboxymethyl cellulose, acrylic polymers, alginates, polyacrylate gums, polyacrylates, microbiocides, oil based defoamers, silicone based defoamers, stilbenes, direct dye, or acid dyes.

In embodiments, an article of manufacture is disclosed including a substrate having a crosslinked-polymer coated layer, where crosslinking is substantially limited to an upper surface of the layer and substantially no crosslinking is contained within the layer.

In a related aspect, the crosslinked-polymer layer affords the article of manufacture higher flexibility, lower stiffness, and/or greater elongation compared to an article of manufacture comprising a substantially similar crosslinking agent and polymer but substantial crosslinking is contained within the layer.

BRIEF DESCRIPTION OF THE DRAWINGS

FIG. 1 shows an illustration of two reactions, where crosslinking of the polymer takes place on and within the film when the crosslinking reaction is carried out in solution (top reaction, prior art) or crosslinking takes place on an exposed surface of a set/dried polymer when the crosslinker is printed on said surface (bottom reaction). Note the qualitative difference in crosslink density between the products of the two reactions.

DETAILED DESCRIPTION OF THE INVENTION

Before the present composition, methods, and methodologies are described, it is to be understood that this invention is not limited to particular compositions, methods, and experimental conditions described, as such compositions, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "a polymer" includes one or more polymers, and/or compositions of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein may be used in the practice or testing of the invention, as it will be understood that modifications and variations are encompassed within the spirit and scope of the instant disclosure.

As used herein, "about," "approximately," "substantially" and "significantly" will be understood by a person of ordinary skill in the art and will vary in some extent depending on the context in which they are used. If there are uses of the term which are not clear to persons of ordinary skill in the art given the context in which it is used, "about" and "approximately" will mean plus or minus <10% of particular term and "substantially" and "significantly" will mean plus or minus >10% of the particular term. "Comprising" and "consisting essentially of" have their customary meaning in the art.

Prior methods and systems for producing crosslinked films, particularly crosslinked PvOH, were performed where the crosslinking agent and polymer are combined in solution (FIG. 1, top reaction). In the method described herein, one or more crosslinking agents are printed on the prior applied base polymer to form the final film (FIG. 1, bottom reaction). Among the benefits which can be achieved by various embodiments of the method is the flexibility and efficiency of the method in creating more insoluble films by more effectively accessing surface—OH groups thereon.

As disclosed herein, a crosslinker is applied by printing or use of a crosslinking agent in a manner more similar to an overcoat varnish on the surface of polymer films. While not being bound by theory, after a polymer film has been set/dried, a crosslinking agent is printed on the dried/set surface and is most likely to react with the —OH groups that are most available on the surface. By applying and heating quickly after application (e.g., less than a minute) the reaction may take place at the surface to create a crosslinked web which assists gloss while insolubilizing the surface.

Advantages include, but are not limited to, ag film application where reduced solubility and slower degradation of the material in the field is warranted, including that savings in general may be realized through lower PvOH content required to achieve the intended functionality. In a parallel vein, the method as disclosed may be useful for products where an insoluble PvOH outer layer is desired (e.g., provide improved tactile sense and look for paper straws).

By optimizing the polymer and the amount of crosslinking agent, the number of products that contain such films may be extended. The disclosed method represents a distinct difference over mixing a crosslinking agent with a polymer in solution, where such mixtures, when applied on paper with subsequent drying at a hot enough temperature to ensure crosslinking, result in a film that is much more soluble when submerged in water compared to products made with the methods as disclosed herein. While not being bound by theory, because of the resulting structural dissimilarities due to the idea that substantial crosslinking should not occur throughout the thickness of the film (see, FIG. 1), the mechanical properties of the film from the method as disclosed will be different, including but not limited to, exhibiting higher flexibility, lower stiffness, and greater elongation.

As used herein, "aqueous" means of or containing water, typically as a solvent or medium.

As used herein, "biobased" means a material intentionally made from substances derived from living (or once-living) organisms. In a related aspect, material containing at least about 50% of such substances is considered biobased.

As used herein, "bind", including grammatical variations thereof, means to cohere or cause to cohere essentially as a single mass.

As used herein, "cellulosic" means natural, synthetic or semisynthetic materials that can be molded or extruded into objects (e.g., bags, sheets) or films or filaments, which may be used for making such objects or films or filaments, that is structurally and functionally similar to cellulose, e.g., coatings and adhesives (e.g., carboxymethylcellulose). In another example, cellulose, a complex carbohydrate $(C_6H_{10}O_5)_n$ that is composed of glucose units, which forms the main constituent of the cell wall in most plants, is cellulosic.

As used herein, "coating weight" is the weight of a material (wet or dry) applied to a substrate. It is expressed in pounds per specified ream or grams per square meter.

As used herein "Cobb value" means the water absorption (in weight of water per unit area) of a sample. The procedure for determining the "Cobb value" is done in compliance with TAPPI standard 441-om. The Cobb value is calculated by subtracting the initial weight of the sample from the final weight of the sample and then dividing by the area of the sample covered by the water. The reported value represents grams of water absorbed per square meter of paper.

As used herein, "compostable" means these solid products are biodegradable into the soil.

As used herein, "crosslinking", including grammatical variations thereof, means bonding that links one polymer chain to another. These links may take the form of covalent bonds or ionic bonds and the polymers can be either synthetic polymers or natural polymers (such as proteins). Crosslinking agents, accordingly, form such links, and include but are not limited to aldehydes, aldehyde-containing resins, polyfunctional carboxylic acids, difunctional methacrylates, N-lactam carboxylates, dithiols, dimethyl urea, di-isocyanates, borates, salts of multivalent anions, inorganic polyions, Group 1B salts, polyamide-epichlorohydrin resin, and combinations thereof. In embodiments, the crosslinking agent may be present in an amount up to about 10% by weight, for example about 1% to about 10% by weight, or 5% to about 10% by weight, based on the weight of the water-soluble polymer.

As used herein, "cross-link density" means the number of chemical cross-links per unit volume in a polymer. Where the cross-link density is defined as the inverse of the molecular weight between cross-links (Mc), the cross-link density can be determined by the equation $$Ge=pRT/Mc,$$

where Ge is the equilibrium modulus as determined by a temperature sweep in dynamic mechanical analysis, p is the density (which may be determined by Archimedes method), R is the universal gas constant in J/mol*K and T is absolute temperature in Kelvin. Once Ge and p are found experimentally, Mc may be calculated, and then finally, the cross-link density. In a related aspect, the film obtained by the method as disclosed herein may have a lower cross-link density compared to a film obtained by a crosslinker and polymer in solution.

In embodiments, a method of preparing a crosslinked film is disclosed including applying a polymer solution to a substrate; drying said polymer solution on the substrate; printing a crosslinking agent on the dried substrate; and heating the printed substrate for a sufficient time to achieve crosslinking, where the resulting crosslinked polymer exhibits greater insolubility relative to a crosslinked polymer generated by application of the same polymer and crosslinking agent combined in solution. In a related aspect, the method further includes optionally evaporating any solvent from the heated substrate to form a crosslinked polymeric film.

In a related aspect, one or more polymers may be blended prior to deposit on the substrate, including that the one or more polymers may be different, where the different polymers are crosslinked together. In another aspect, the polymer is linked to a smaller molecule, where the small molecule is added for functionality (e.g., use of a crosslinker to adhere a low degree of substitution sucrose ester to a substrate to achieve water resistance and/or grease resistance).

In embodiments, an article of manufacture is disclosed including a substrate having a crosslinked-polymer coated layer, where crosslinking is substantially limited to an upper surface of the layer and substantially no crosslinking is contained within the layer. In one aspect, the article of manufacture exhibits a lower cross-link density than an article of manufacture generated by a method which deposits onto a substrate a mixture of crosslinking agent and polymer as a solution.

In one aspect, the crosslinked-polymer layer affords the article of manufacture higher flexibility, lower stiffness, and/or greater elongation compared to an article of manufacture comprising a substantially similar crosslinking agent and polymer but substantial crosslinking is contained within the layer.

In embodiments, as used herein, "edge wicking" means the sorption of water in a paper structure at the outside limit of said structure by one or more mechanisms including, but not limited to, capillary penetration in the pores between fibers, diffusion through fibers and bonds, and surface diffusion on the fibers. In a related aspect, the polymer film as described herein prevents edge wicking in treated products. In one aspect, a similar problem exists with grease/oil entering creases that may be present in paper or paper products. Such a "grease creasing effect" may be defined as the sorption of grease in a paper structure that is created by folding, pressing or crushing said paper structure.

As used herein, "effect", including grammatical variations thereof, means to impart a particular property to a specific material.

As used herein, "hydrophobe" means a substance that does not attract water. For example, waxes, rosins, resins, saccharide fatty acid esters, diketenes, shellacs, vinyl acetates, PLA, PEI, oils, fats, lipids, other water repellant chemicals or combinations thereof are hydrophobes.

As used herein, "hydrophobicity" means the property of being water-repellent, tending to repel and not absorb water.

As used herein, "lipid resistance" or "lipophobicity" means the property of being lipid-repellent, tending to repel and not absorb lipids, grease, fats and the like. In a related aspect, the grease resistance may be measured by a "3M KIT" test or a TAPPI T559 Kit test.

As used herein, "laminated structures" means an article of manufacture constructed from multiple layers of sheet material joined together by adhesive. For example, paper tubes, paper drinking straws and corrugated paperboard are all laminated structures.

As used herein, "cellulose-containing material" or "cellulose-based material" means a composition which consists essentially of cellulose. For example, such material may include, but is not limited to, paper, paper sheets, paperboard, paper pulp, a carton for food storage, parchment paper, cake board, butcher paper, release paper/liner, paper straws, a bag for food storage, paper drinking straw, paper tube, corrugated paperboard, a shopping bag, a shipping bag, bacon board, insulating material, tea bags, containers for coffee or tea, a compost bag, eating utensil, container for holding hot or cold beverages, cup, a lid, plate, a bottle for carbonated liquid storage, gift cards, a bottle for non-carbonated liquid storage, film for wrapping food, a garbage disposal container, a food handling implement, a fabric fibre (e.g., cotton or cotton blends), a water storage and conveying implement, alcoholic or non-alcoholic drinks, an outer casing or screen for electronic goods, an internal or external piece of furniture, a curtain and upholstery.

As used herein, "release paper" means a paper sheet used to prevent a sticky surface from prematurely adhering to an adhesive or a mastic. In one aspect, the film as disclosed herein can be used to replace or reduce the use of silicon or other coatings to produce a material having a low surface energy. Determining the surface energy may be readily achieved by measuring contact angle (e.g., Optical Tensiometer and/or High Pressure Chamber; Dyne Testing, Staffordshire, United Kingdom) or by use of Surface Energy Test Pens or Inks (see, e.g., Dyne Testing, Staffordshire, United Kingdom).

As used herein, "substrate" means a material which provides the surface on which something is deposited or inscribed.

As used herein, "fibers in solution" or "pulp" means a lignocellulosic fibrous material prepared by chemically or mechanically separating cellulose fibers from wood, fiber crops or waste paper. In a related aspect, where cellulose fibers are treated by the methods as disclosed herein, the cellulose fibers themselves contain bound film as isolated entities, and where the bound cellulose fibers have separate and distinct properties from free fibers.

As used herein, "repulpable" means to make a paper or paperboard product suitable for crushing into a soft, shapeless mass for reuse in the production of paper or paperboard.

As used herein, "tunable", including grammatical variations thereof, means to adjust or adapt a process to achieve a particular result.

As used herein, "water contact angle" means the angle measured through a liquid, where a liquid/vapor interface meets a solid surface. It quantifies the wettability of the solid surface by the liquid. The contact angle is a reflection of how strongly the liquid and solid molecules interact with each other, relative to how strongly each interacts with its own kind. On many highly hydrophilic surfaces, water droplets will exhibit contact angles of 0° to 30°. Generally, if the water contact angle is larger than 90°, the solid surface is considered hydrophobic. Water contact angle may be readily obtained using an Optical Tensiometer (see, e.g., Dyne Testing, Staffordshire, United Kingdom).

As used herein, "water vapour permeability" means breathability or a textile's ability to transfer moisture. There are at least two different measurement methods. One, the MVTR Test (Moisture Vapour Transmission Rate) in accordance with ISO 15496, describes the water vapor permeability (WVP) of a fabric and therefore the degree of perspiration transport to the outside air. The measurements determine how many grams of moisture (water vapor) pass through a square meter of fabric in 24 hours (the higher the level, the higher the breathability).

In one aspect, TAPPI T 530 Hercules size test (i.e., size test for paper by ink resistance) may be used to determine water resistance. Ink resistance by the Hercules method is best classified as a direct measurement test for the degree of penetration. Others classify it as a rate of penetration test. There is no one best test for "measuring sizing." Test selection depends on end use and mill control needs. This method is especially suitable for use as a mill control sizing test to accurately detect changes in sizing level. It offers the sensitivity of the ink float test while providing reproducible results, shorter test times, and automatic end point determination.

Sizing, as measured by resistance to permeation through or absorption into paper of aqueous liquids, is an important characteristic of many papers. Typical of these are bag, containerboard, butcher's wrap, writing, and some printing grades.

This method may be used to monitor paper or board production for specific end uses provided acceptable correlation has been established between test values and the paper's end use performance. Due to the nature of the test and the penetrant, it will not necessarily correlate sufficiently to be applicable to all end use requirements. This method measures sizing by rate of penetration. Other methods measure sizing by surface contact, surface penetration, or absorption. Size tests are selected based on the ability to simulate the means of water contact or absorption in end use. This method can also be used to optimize size chemical usage costs.

Tests to be performed may also include, but are not limited to, bond strength, cure time, smoothness, paper stiffness, water resistance (hot water and cold water), printability, beam strength, ease of cutting, forming, and putty adhesion.

As used herein, "oxygen permeability" means the degree to which a polymer allows the passage of a gas or fluid. Oxygen permeability (Dk) of a material is a function of the diffusivity (D) (i.e., the speed at which oxygen molecules traverse the material) and the solubility (k) (or the amount of oxygen molecules absorbed, per volume, in the material). Values of oxygen permeability (Dk) typically fall within the range $10\text{-}150\times10^{-11}$ ($cm^2$ ml $O_2$)/(s ml mmHg). A semi-logarithmic relationship has been demonstrated between hydrogel water content and oxygen permeability (Unit: Barrer unit). The International Organization for Standardization (ISO) has specified permeability using the SI unit hectopascal (hPa) for pressure. Hence $Dk=10^{-11}$ ($cm^2$ ml $O_2$)/(s ml hPa). The Barrer unit can be converted to hPa unit by multiplying it by the constant 0.75.

As used herein, "print", including grammatical variations thereof, means to impress something in or on a surface or on a surface of a substrate. In a related aspect, the method as disclosed herein may comprise a water-based printing technology including, but not limited to, flexography, UV printing, rotogravure, ink jet, Indigo, and offset printing.

As used herein, "polymer", means a substance that has a molecular structure consisting chiefly or entirely of a large number of similar units bonded together. For example, such polymers include, but are not limited to, polyvinyl alcohols, polyethylene oxides, dextrans, starches, cellulose derivatives (e.g., hemicelluloses, hydroxyethyl cellulose, hydroxypropyl cellulose, and other cellulose ethers), lignins, polyvinylpyrrolidone, polyacrylamide, polyacrylic acid, polyacrylates, pectin, alginates, proteins, derivatized proteins (e.g., gelatin, corn zein, whey protein) and combinations thereof. In a related aspect, the polymer is polyvinyl alcohol.

As used herein "biodegradable", including grammatical variations thereof, means capable of being broken down especially into innocuous products by the action of living things (e.g., by microorganisms).

As used herein, "recyclable", including grammatical variations thereof, means a material that is treatable or that can be processed (with used and/or waste items) so as to make said material suitable for reuse.

As used herein "latex" means a stable dispersion (emulsion) of polymer microparticles in an aqueous medium. It is found in nature, but synthetic latexes can be made by polymerizing a monomer such as styrene that has been emulsified with surfactants. Latex as found in nature is a milky fluid found in 10% of all flowering plants (angiosperms). It is a complex emulsion consisting of proteins, alkaloids, starches, sugars, oils, tannins, resins, and gums that coagulate on exposure to air.

As used herein, "filler" means finely divided white mineral (or pigments) added to paper making furnishes to improve the optical and physical properties of the sheet. The particles serve to fill in the spaces and crevices between the fibers, thus, producing a sheet with increased brightness, opacity, smoothness, gloss, and printability, but generally, lower bonding and tear strength. Common paper making fillers include clay (kaolin, bentonite), calcium carbonate (both GCC and PCC), talc (magnesium silicate), and titanium dioxide.

As used herein, "Gurley second" or "Gurley number" is a unit describing the number of seconds required for 100 cubic centimeters (deciliter) of air to pass through 1.0 square inch of a given material at a pressure differential of 4.88 inches of water (0.176 psi) (ISO 5636-5:2003)(Porosity). In addition, for stiffness, "Gurley number" is a unit for a piece of vertically held material measuring the force required to deflect said material a given amount (1 milligram of force). Such values may be measured on a Gurley Precision Instruments' device (Troy, New York).

As used herein "wet strength" means the measure of how well the web of fibers holding the paper together can resist a force of rupture when the paper is wet. The wet strength may be measured using a Finch Wet Strength Device from Thwing-Albert Instrument Company (West Berlin, NJ). Where the wet strength is typically effected by wet strength additives such as kymene, cationic glyoxylated resins, polyamidoamine-epichlorohydrin resins, polyamine-epichlorohydrin resins, including epoxide resins. In embodiments, film as disclosed herein effects such wet strength in the absence of such additives.

As used herein "wet" means covered or saturated with water or another liquid.

As disclosed herein, the print method has demonstrated that the amount of PvOH may be reduced to produce an insoluble film. While it is known in the art that PvOH is itself a good film former, and forms strong hydrogen bonds with cellulose, it is not very resistant to water, particularly hot water. In one aspect, PvOH provides a rich source of OH groups to crosslink along the fibers, which increases the strength of paper, for example, particularly wet strength, and water resistance beyond what is possible with PvOH alone. Crosslinking agents may include a dialdehyde (e.g., glyoxal, glutaraldehyde, and the like).

In embodiments, a substrate may comprise a starch, where the starch may be derived from any suitable source such as dent corn starch, waxy corn starch, potato starch, wheat starch, rice starch, sago starch, tapioca starch, sorghum starch, sweet potato starch, and mixtures thereof.

In more detail, the starch may be an unmodified starch, or a starch that has been modified by a chemical, physical, or enzymatic modification.

Chemical modification includes any treatment of a starch with a chemical that results in a modified starch (e.g., plastarch material). Within chemical modification are included, but not limited to, depolymerization of a starch, oxidation of a starch, reduction of a starch, etherification of a starch, esterification of a starch, nitrification of a starch, defatting of a starch, hydrophobization of a starch, and the like. Chemically modified starches may also be prepared by using a combination of any of the chemical treatments. Examples of chemically modified starches include the reaction of alkenyl succinic anhydride, particularly octenyl succinic anhydride, with starch to produce a hydrophobic esterified starch; the reaction of 2,3-epoxypropyltrimethylammonium chloride with starch to produce a cationic starch; the reaction of ethylene oxide with starch to produce hydroxyethyl starch; the reaction of hypochlorite with starch to produce an oxidized starch; the reaction of an acid with starch to produce an acid depolymerized starch; defatting of a starch with a solvent such as methanol, ethanol, propanol, methylene chloride, chloroform, carbon tetrachloride, and the like, to produce a defatted starch.

Physically modified starches are any starches that are physically treated in any manner to provide physically modified starches. Within physical modification are included, but not limited to, thermal treatment of the starch in the presence of water, thermal treatment of the starch in the absence of water, fracturing the starch granule by any mechanical means, pressure treatment of starch to melt the starch granules, and the like. Physically modified starches may also be prepared by using a combination of any of the physical treatments. Examples of physically modified starches include the thermal treatment of starch in an aqueous environment to cause the starch granules to swell without granule rupture; the thermal treatment of anhydrous starch granules to cause polymer rearrangement; fragmentation of the starch granules by mechanical disintegration; and pressure treatment of starch granules by means of an extruder to cause melting of the starch granules.

Enzymatically modified starches are any starches that are enzymatically treated in any manner to provide enzymatically modified starches. Within enzymatic modification are included, but not limited to, the reaction of an alpha amylase with starch, the reaction of a protease with starch, the reaction of a lipase with starch, the reaction of a phosphorylase with starch, the reaction of an oxidase with starch, and the like. Enzymatically modified starches may be prepared by using a combination of any of the enzymatic treatments. Examples of enzymatic modification of starch include the reaction of alpha-amylase enzyme with starch to produce a depolymerized starch; the reaction of alpha amylase debranching enzyme with starch to produce a debranched starch; the reaction of a protease enzyme with starch to produce a starch with reduced protein content; the reaction of a lipase enzyme with starch to produce a starch with reduced lipid content; the reaction of a phosphorylase enzyme with starch to produce an enzyme modified phosphated starch; and the reaction of an oxidase enzyme with starch to produce an enzyme oxidized starch.

In embodiments, a polymer solution may comprise between about 10% to about 90%, about 10% to about 20%, about 30% to about 40%, about 50% to about 60%, about 70% to about 80%, about 80% to about 90% polymer by weight of the solution (wt/wt). In a related aspect, the coating may contain between about 80% to about 99% polymer by weight of the coating (wt/wt).

In embodiments, the crosslinking agent is present in an amount up to about 10% by weight based on the weight of the polymer. In a related aspect, the crosslinking agent is present in an amount in a range of about 1% to about 2%, about 2% to about 3%, about 3% to about 4%, about 4% to about 5%, about 5% to about 6%, about 6% to about 7%, about 7% to about 8%, about 8% to about 9%, about 9% to about 10% by weight, based on the weight of the polymer.

In embodiments, the cellulose-based material includes, but is not limited to, paper, paperboard, paper sheets, paper pulp, cups, boxes, trays, lids, release papers/liners, compost bags, shopping bags, shipping bags, paper straws, paper tubes, corrugated paperboard, bacon board, tea bags, insulating material, containers for coffee or tea, pipes and water conduits, food grade disposable cutlery, plates and bottles, screens for TV and mobile devices, clothing (e.g., cotton or cotton blends), bandages, pressure sensitive labels, pressure sensitive tape, feminine products, and medical devices to be used on the body or inside it such as contraceptives, drug delivery devices, container for pharmaceutical materials (e.g., pills, tablets, suppositories, gels, etc.), and the like. Also, the coating technology as disclosed may be used on furniture and upholstery, outdoors camping equipment and the like.

In one aspect, the coatings as described herein are resistant to pH in the range of between about 3 to about 9. In a related aspect, the pH may be from about 3 to about 4, about 4 to about 5, about 5 to about 7, about 7 to about 9.

In one aspect, the polymer solutions may contain adhesives, proteins, polysaccharides and/or lipids, including but not limited to, milk proteins (e.g., casein, whey protein and the like), wheat glutens, gelatins, prolamines (e.g., corn zein), proteins, protein isolates, starches, acetylated polysaccharides, alginates, latexes, carrageenans, chitosans, inulins, long chain fatty acids, waxes, and combinations thereof.

In embodiments the polymer solution as disclosed herein may be used to carry other chemicals used for paper manufacturing including, but not limited to, agalite, esters, diesters, ethers, ketones, amides, nitriles, aromatics (e.g., xylenes, toluenes), acid halides, anhydrides, alkyl ketene dimer (AKD), alabaster, alganic acid, alum, albarine, glues, barium carbonate, barium sulfate, chlorine dioxide, dolomite, diethylene triamine penta acetate, EDTA, enzymes, formamidine sulfuric acid, guar gum, gypsum, lime, magnesium bisulfate, milk of lime, milk of magnesia, rosins, rosin soaps, satins, soaps/fatty acids, sodium bisulfate, soda-ash, titania, surfactants, starches, modified starches, hydrocarbon resins, polymers, waxes, polysaccharides, proteins, latex, and combinations thereof. In embodiments, the polymer solution as disclosed may contain one or more polymers and one or more of the following inorganic particles: clay (kaolin, bentonite), calcium carbonate (both GCC and PCC), talc (magnesium silicate), and titanium dioxide.

In embodiments, the films generated by the methods as disclosed herein exhibit greater insolubility relative to the films not made by the disclosed method. In a related aspect, the resulting film may exhibit greater lipophobicity or grease resistance relative to film made by a solution containing combined crosslinking agent and polymer. In a further related aspect, the resulting film may be biodegradable, compostable, and/or recyclable. In one aspect, the resulting film is hydrophobic (water resistant) and/or lipophobic (grease resistant).

In embodiments, the resulting film as disclosed herein may have improved mechanical properties compared to film not made by the disclosed method. For example, paper bags treated by the process as disclosed herein may show increased burst strength, Gurley Number, Tensile Strength and/or Energy of Maximum Load. In one aspect, the burst strength is increased by a factor of between about 0.5 to 1.0 fold, between about 1.0 and 1.1 fold, between about 1.1 and 1.3 fold, between about 1.3 to 1.5 fold. In another aspect, the Gurley Number increased by a factor of between about 3 to 4 fold, between about 4 to 5 fold, between about 5 to 6 fold and about 6 to 7 fold. In still another aspect, the Tensile Strain increased by a factor of between about 0.5 to 1.0 fold, between about 1.0 to 1.1 fold, between about 1.1 to 1.2 fold and between about 1.2 to 1.3 fold. And in another aspect, the Energy of Max Load increased by a factor of between about 1.0 to 1.1 fold, between about 1.1 to 1.2 fold, between about 1.2 to 1.3 fold, and between about 1.3 to 1.4 fold.

In embodiments, the cellulose-containing material is a base paper comprising microfibrillated cellulose (MFC) or cellulose nanofiber (CNF) as described for example in U.S. Pub. No. 2015/0167243 (herein incorporated by reference in its entirety), where the MFC or CNF is added during the forming process and paper making process and/or added as a coating or a secondary layer to a prior forming layer to decrease the porosity of said base paper. In a related aspect, the base paper is contacted with a polymer solution and printed as described above. In a further related aspect, the polymer in the contacted base paper is PvOH. In embodiments, the resulting contacted base paper is tuneably water and lipid resistant. In a related aspect, the resulting base paper may exhibit a Gurley value of at least about 10-15 (i.e., Gurley Air Resistance (sec/100 cc, 20 oz. cyl.)), or at least about 100, at least about 200 to about 350. In one aspect, the film may act as a laminate for one or more layers or may provide one or more layers as a laminate or may reduce the amount of coating of one or more layers to achieve the same performance effect (e.g., water resistance, grease resistance, and the like). In a related aspect, the laminate may comprise a biodegradable and/or compostable heat seal or adhesive.

In embodiments, the polymer solution may be formulated as emulsions, where the choice emulsifying agent and the amount employed is dictated by the nature of the composition and the ability of the agent to facilitate the dispersion of the polymer. In one aspect, the emulsifying agents may include, but are not limited to, water, buffers, carboxymethyl cellulose (CMC), latex, milk proteins, wheat glutens, gelatins, prolamines, soy protein isolates, starches, acetylated polysaccharides, alginates, carrageenans, chitosans, inulins, long chain fatty acids, fatty acid esters, sucrose esters, waxes, agar, alginates, glycerol, gums, lecithins, poloxamers, mono-, di-glycerols, monosodium phosphates, monostearate, propylene glycols, detergents, cetyl alcohol, and combinations thereof. In another aspect, the polymer:emulsifying agent ratios may be from about 0.1:99.9, from about 1:99, from about 10:90, from about 20:80, from about 35:65, from about 40:60, and from about 50:50. It will be apparent to one of skill in the art that ratios may be varied depending on the property(ies) desired for the final product.

In embodiments, the polymer may be combined with one or more coating components for internal and surface sizing (alone or in combination), including but not limited to, binders (e.g., starch, protein, latexes, polymer emulsions), additives (e.g., zirconium salts, calcium stearate, lecithin oleate, polyethylene emulsion, carboxymethyl cellulose, acrylic polymers, alginates, polyacrylate gums, polyacrylates, microbiocides, oil based defoamers, silicone based defoamers, stilbenes, direct dyes and acid dyes) and varnishes. In a related aspect, such components may provide one or more properties, including but not limited to, building a fine porous structure, providing light scattering surface, improving ink receptivity, improving gloss, binding pigment particles, binding coatings to paper, base sheet reinforcement, filling pores in pigment structure, reducing water sensitivity, resisting wet pick in offset printing, preventing blade scratching, improving gloss in supercalendering, reducing dusting, adjusting coating viscosity, providing water holding, dispersing pigments, maintaining coating dispersion, preventing spoilage of coating/coating color, controlling foaming, reducing entrained air and coating craters, increasing whiteness and brightness, and controlling color and shade. It will be apparent to one of skill in the art that combinations may be varied depending on the property(ies) desired for the final product.

The method as disclosed may be used to lower the cost of applications of primary/secondary coating (e.g., silicone-based layer, starch-based layer, clay-based layer, PLA-layer, Bio-PBS, PEI-layer and the like) by providing a layer of material that exhibits a necessary property (e.g., water resistance, low surface energy, and the like), thereby reducing the amount of primary/secondary layer necessary to achieve that same property. In embodiments, the composition is fluorocarbon and silicone free.

In embodiments, the compositions increase both mechanical and thermal stability of the treated product. In one aspect, the surface treatment is thermostable at temperatures between about −100° C. to about 300° C. In a further related aspect, the surface of the cellulose-based material exhibits a water contact angle of between about 60° to about 120°. In another related aspect, the surface treatment is chemically stable at temperatures of between about 200° C. to about 300° C.

The substrate which is dried prior to application (e.g., at about 80-150° C.), may be treated with the crosslinking agent by printing. The substrate may be heated to dry the surface, after which the modified material is ready for use. In one aspect, according to the method as disclosed herein the substrate may be treated by any suitable coating/sizing process typically carried out in a paper mill (see, e.g., Smook, G., Surface Treatments in *Handbook for Pulp & Paper Technologists*, (2016), 4$^{th}$ Ed., Cpt. 18, pp. 293-309, TAPPI Press, Peachtree Corners, GA USA, herein incorporated by reference in its entirety).

In embodiments, the methods as disclosed may be used on any cellulose-based surface, including but not limited to, a film, a rigid container, fibers, pulp, a fabric or the like.

Depending on the source, the cellulose may be paper, paperboard, pulp, softwood fiber, hardwood fiber, or combinations thereof, nanocellulose, cellulose nanofibres, whiskers or microfibril, microfibrillated, cotton or cotton blends, other non-wood fibers, (such as sisal, jute or hemp, flax and straw) cellulose nanocrystals, or nanofibrillated cellulose.

In embodiments, the amount of polymer solution applied is sufficient to completely cover at least one surface of a cellulose-containing material. For example, in embodiments, the polymer solution may be applied to the complete outer surface of a container, the complete inner surface of a container, or a combination thereof, or one or both sides of a base paper. In other embodiments, the complete upper surface of a substrate may be covered by the polymer solution, or the complete under surface of a substrate may be covered by the polymer solution, or a combination thereof. In some embodiments, the lumen of a device/instrument may be covered by the polymer solution or the outer surface of the device/instrument may be covered by the polymer solution, or a combination thereof. In embodiments, the amount of polymer solution applied is sufficient to partially cover at least one surface of a cellulose-containing material. For example, only those surfaces exposed to the ambient atmosphere are covered by the polymer solution, or only those surfaces that are not exposed to the ambient atmosphere are covered by the polymer solution (e.g., masking). As will be apparent to one of skill in the art, the amount of polymer solution applied may be dependent on the use of the material to be covered. In one aspect, one surface may be coated with a polymer solution and the opposing surface may be coated with an agent including, but not limited to, proteins, wheat glutens, gelatins, prolamines, protein isolates, starches, modified starches, acetylated polysaccharides, alginates, carrageenans, chitosans, inulins, long chain fatty acids, waxes, and combinations thereof. In a related aspect, the polymer solution can be added to a furnish, and the resulting material on the web may be provided with an additional coating of polymer solution.

It will be apparent to one of skill in the art that the selection of cellulose to be treated, the polymer, the crosslinking agent, the reaction temperature, and the exposure time are process parameters that may be optimized by routine experimentation to suit any particular application for the final product.

The derivatized materials have altered physical properties which may be defined and measured using appropriate tests known in the art. For hydrophobicity the analytical protocol may include, but is not limited to, the contact angle measurement and moisture pick-up. Other properties include, stiffness, WVTR, porosity, tensile strength, lack of substrate degradation, burst and tear properties. A specific standardized protocol to follow is defined by the American Society for Testing and Materials (protocol ASTM D7334-08).

The permeability of a surface to various gases such as water vapour and oxygen may also be altered by the disclosed process as the barrier function of the material is enhanced. The standard unit measuring permeability is the Barrer and protocols to measure these parameters are also available in the public domain (ASTM std F2476-05 for water vapour and ASTM std F2622-8 for oxygen).

In embodiments, materials treated according to the presently disclosed procedure display a complete biodegradability as measured by the degradation in the environment under microorganismal attack.

Various methods are available to define and test biodegradability including the shake-flask method (ASTM E1279-89 (2008)) and the Zahn-Wellens test (OECD TG 302 B).

Various methods are available to define and test compostability including, but not limited to, ASTM D6400.

Materials suitable for treatment by the process of this invention include various forms of cellulose, such as cotton fibers, plant fibers such as flax, wood fibers, regenerated cellulose (rayon and cellophane), partially alkylated cellulose (cellulose ethers), partially esterified cellulose (acetate rayon), and other modified cellulose materials which have a substantial portion of their surfaces available for reaction/ binding. As stated above, the term "cellulose" includes all of these materials and others of similar polysaccharide structure and having similar properties. Among these the relatively novel material microfibrillated cellulose (cellulose nanofiber) (see e.g., U.S. Pat. No. 4,374,702 and US Pub. Nos. 2015/0167243 and 2009/0221812, herein incorporated by reference in their entireties) is particularly suitable for this application. In other embodiments, celluloses may include but are not limited to, cellulose triacetate, cellulose propionate, cellulose acetate propionate, cellulose acetate butyrate, nitrocellulose (cellulose nitrate), cellulose sulfate, celluloid, methylcellulose, ethylcellulose, ethyl methyl cellulose, hydroxyethyl cellulose, hydroxypropyl cellulose, cellulose nanocrystals, hydroxyethyl methyl cellulose, hydroxypropyl methyl cellulose, ethyl hydroxyethyl cellulose, carboxymethyl cellulose, and combinations thereof.

The modification of the cellulose as disclosed herein, in addition to increasing its hydrophobicity, may also increase its tensile strength, flexibility and stiffness, thereby further widening its spectrum of use. All biodegradable and partially biodegradable products made from or by using the modified cellulose disclosed in this application are within the scope of the disclosure, including recyclable and compostable products.

Among the possible applications of the coating technology such items include, but are not limited to, containers for all purpose such as paper, paperboard, paper pulp, cups, lids, boxes, trays, release papers/liners, compost bags, shopping bags, pipes and water conduits, food grade disposable cutlery, plates and bottles, screens for TV and mobile devices, clothing (e.g., cotton or cotton blends), bandages, pressure sensitive labels, pressure sensitive tape, feminine products, and medical devices to be used on the body or inside it such as contraceptives, drug delivery devices, and the like. Also, the coating technology as disclosed may be used on furniture and upholstery, outdoors camping equipment and the like.

The following examples are intended to illustrate but not limit the invention.

EXAMPLES

Example 1

Polyvinyl alcohol (PvOH) was coated onto a 20# bleached hardwood sheet using a rod coater. The PvOH (Selvol 425 from Sekisui Chemical, Japan) film was applied at 5 g/m$^2$ and dried. Glyoxal was applied via web offset printing (heatset) and the film examined for water resistance. 5 mL of water was placed on the PvOH film of both untreated and glyoxal treated papers and left for 15 minutes. After 15 minutes, the untreated PvOH film had dissolved in the water and the paper substrate had become saturated. The treated paper retained the insolubilized PvOH film on the surface evidenced by the water pooled on the film.

Example 2

A fully hydrolyzed PvOH was coated on a first base paper to provide a film that would ultimately make the paper, inter alia, water resistant. The PvOH was applied at 6 g/m$^2$ to achieve the desired properties. On a second base paper, it was found that nearly identical properties could be achieved using PvOH at a coat weight of 4 g/m$^2$ followed by printing glyoxal to crosslink surface —OH groups.

Although the invention has been described with reference to the above examples, it will be understood that modifications and variations are encompassed within the spirit and scope of the invention. Accordingly, the invention is limited only by the following claims. All references disclosed herein are hereby incorporated by reference in their entireties.

What is claimed:

1. A method of preparing a crosslinked film, comprising the steps of:

a) applying a polymer solution to a substrate;

b) drying said polymer solution on said substrate;

c) printing a crosslinking agent on said dried substrate; and d) heating the printed substrate for a sufficient time to achieve crosslinking to form a crosslinked polymeric film, wherein the resulting crosslinked polymer exhibits greater insolubility relative to a crosslinked polymer generated by application of the same polymer and crosslinking agent combined in solution.

2. The method of claim 1, wherein the polymer is selected from the group consisting of polyvinyl alcohols, polyethylene oxides, dextrans, starches, hemicelluloses, hydroxyethyl cellulose, hydroxypropyl cellulose, cellulose ethers, lignins, polyvinylpyrrolidone, polyacrylamide, polyacrylic acid, polyacrylates, pectin, alginates, proteins, gelatin, corn zein, whey protein, and combinations thereof.

3. The method of claim 2, wherein the substrate is a cellulosic material.

4. The method of claim 3, wherein the cellulosic-material is selected from the group consisting of paper, paperboard, paper pulp, a carton for food storage, a bag for food storage, a shipping bag, a container for coffee or tea, a tea bag, bacon board, diapers, weed-block/barrier fabric or film, mulching film, plant pots, packing beads, bubble wrap, oil absorbent material, laminates, envelops, gift cards, credit cards, gloves, raincoats, OGR paper, a shopping bag, a compost bag, release paper, eating utensil, container for holding hot or cold beverages, cup, paper towels, plate, a bottle for carbonated liquid storage, insulating material, a bottle for non-carbonated liquid storage, film for wrapping food, a garbage disposal container, a food handling implement, a lid for a cup, paper straws, a fabric fibre, a water storage and conveying implement, paperboard from medical use, release paper, a storage and conveying implement for alcoholic or non-alcoholic drinks, an outer casing or screen for electronic goods, an internal or external piece of furniture, a curtain, upholstery, film, box, sheet, tray, pipe, water conduit, packaging for pharmaceutical products, clothing, medical device, contraceptive, camping equipment, cellulosic material that is molded and combinations thereof.

5. The method of claim 3, wherein the polymer is polyvinyl alcohol.

6. The method of claim 1, wherein the crosslinking agent is selected from the group consisting of aldehydes, aldehyde-containing resins, polyfunctional carboxylic acids, difunctional methacrylates, ammonium zirconium carbonate, N-lactam carboxylates, dithiols, dimethyl urea, di-isocyanates, borates, salts of multivalent anions, inorganic polyions, Group 1B salts, polyamide-epichlorohydrin resin, and combinations thereof.

7. The method of claim 6, wherein the crosslinking agent is selected from the group consisting of aldehydes, aldehyde-containing resins, dicarboxylic acids, and combinations thereof.

8. The method of claim 7, wherein the crosslinking agent comprises an aldehyde.

9. The method of claim 8, wherein the crosslinking agent comprises a dialdehyde.

10. The method of claim 9, wherein the crosslinking agent comprises glyoxal, glutaraldehyde, or a mixture thereof.

11. The method of claim 10, wherein the crosslinking agent is glyoxal.

12. The method of claim 1, wherein the crosslinking agent is present in an amount up to about 10% by weight based on the weight of the polymer.

13. The method of claim 12, wherein the polymer is present in an amount in a range of about 50% to 90% by weight, based on the weight of the polymer solution.

14. The method of claim 1, wherein the printing is selected from the group consisting of flexography, rotogravure, ink jet, Indigo, and offset printing.

15. The method of claim 1, wherein the method tuneably derivatizes the substrate for hydrophobic and/or lipophobic resistance.

16. The method of claim 15, wherein the resulting substrate is hydrophobic.

17. The method of claim 15, where in the resulting substrate is lipophobic.

18. The method of claim 17, wherein the resulting substrate exhibits a 3M grease KIT test value of between 3 and 12.

19. The method of claim 1, wherein the polymer solution is provided as an emulsion.

20. The method of claim 1, wherein the polymer solution comprises one or more of clay, calcium carbonate, titanium dioxide, plastic pigment, binders, starch, protein, polymer emulsions, latex, zirconium salts, calcium stearate, lecithin oleate, polyethylene emulsion, carboxymethyl cellulose, acrylic polymers, alginates, polyacrylate gums, polyacrylates, microbiocides, oil based defoamers, silicone based defoamers, stilbenes, direct dyes or acid dyes.

* * * * *